United States Patent [19]

Kirk

[11] 4,340,018

[45] Jul. 20, 1982

[54] INTERNAL COMBUSTION ENGINE HAVING A WET-TYPE CYLINDER LINER AND PROCESS FOR MANUFACTURING SAME

[75] Inventor: J. David Kirk, Waukegan, Ill.

[73] Assignee: Outboard Marine Corporation, Waukegan, Ill.

[21] Appl. No.: 106,490

[22] Filed: Dec. 26, 1979

[51] Int. Cl.[3] ..... F02F 1/16

[52] U.S. Cl. ..... 123/193 C; 123/41.84

[58] Field of Search ..... 123/41.67, 41.81, 41.72, 123/41.83, 41.84, 65 VC, 73 A, 73 PP, 74 AA, 193 R, 193 C

[56] References Cited

U.S. PATENT DOCUMENTS

| | | | |
|---|---|---|---|
| 1,260,861 | 3/1918 | Bie | 123/41.84 |
| 1,330,409 | 2/1920 | Taylor | 123/41.84 |
| 1,396,890 | 11/1921 | Short | 123/41.83 |
| 1,765,230 | 6/1930 | Guernsey | 123/41.84 |
| 2,066,580 | 1/1937 | Severin et al. | 123/41.83 |
| 2,845,052 | 7/1958 | Okonski | 123/73 A |
| 3,077,187 | 2/1963 | Stancliff et al. | 123/41.82 |
| 3,156,224 | 11/1964 | Winkler | 123/41.83 |
| 3,379,179 | 4/1968 | Mantzel | 123/41.83 |
| 3,382,857 | 5/1968 | Foster et al. | 123/73 R |
| 3,800,751 | 4/1974 | Glassey et al. | 123/41.84 |
| 3,851,631 | 12/1974 | Kiekhaefer | 123/55 R |
| 3,853,099 | 12/1974 | Feather et al. | 123/41.82 |
| 3,858,562 | 1/1975 | Lanpheer | 123/73 A |

FOREIGN PATENT DOCUMENTS

| | | | |
|---|---|---|---|
| 625796 | 2/1936 | Fed. Rep. of Germany | 123/41.84 |

*Primary Examiner*—Craig R. Feinberg
*Assistant Examiner*—W. R. Wolfe
*Attorney, Agent, or Firm*—Michael, Best & Friedrich

[57] ABSTRACT

A preformed cylinder liner for an internal combustion engine comprises a cylindrical sleeve including a sidewall defining a bore having oppositely spaced ends, the sidewall having therein a port. An exhaust passage integral with the sleeve communicates with the bore through the port. The exhaust passage includes an end portion extending outwardly of the sleeve sidewall and axially toward one of the bore ends. A cylinder block fabricated separately from the pre-formed cylinder liner has therein an interior chamber having a liner-receiving portion which accommodates the removable placement of the cylinder liner substantially wholly within the confines of the liner-receiving portion of the interior chamber, with the bore of the liner sealed from communication with the liner-receiving portion of the interior block chamber. The liner-receiving portion of the interior chamber is adapted to be connected to a source of liquid coolant. Direct cooling of the entire cylinder liner can be thereby provided. A cylinder head is fabricated separately from the block and the cylinder liner. The cylinder head has therein an exhaust passage communicating with the atmosphere. The cylinder head is mounted on the cylinder block with the cylinder head exhaust passage communicating with the exhaust passage of the cylinder liner.

17 Claims, 4 Drawing Figures

INTERNAL COMBUSTION ENGINE HAVING A WET-TYPE CYLINDER LINER AND PROCESS FOR MANUFACTURING SAME

FIELD OF THE INVENTION

The invention relates generally to internal combustion engines. More particularly, the invention relates to liquid cooled internal combustion engines and processes for manufacturing same.

DESCRIPTION OF THE PRIOR ART

Attention is directed to the following U.S. Pat. Nos.

| | | |
|---|---|---|
| Bie | 1,260,861 | March 26, 1918 |
| Short | 1,396,890 | November 15, 1921 |
| Guernsey | 1,765,230 | June 17, 1930 |
| Severin et al | 2,066,580 | January 5, 1937 |
| Okonski | 2,845,052 | July 29, 1958 |
| Stancliff et al | 3,077,187 | February 12, 1963 |
| Winkler | 3,156,224 | November 10, 1964 |
| Mantzel | 3,379,179 | April 23, 1968 |
| Foster et al | 3,382,857 | May 14, 1968 |
| Glassey et al | 3,800,751 | April 2, 1974 |
| Kiekhaefer | 3,851,631 | December 3, 1974 |
| Feather et al | 3,853,099 | December 10, 1974 |
| Lanpheer | 3,858,562 | January 7, 1975 |

Attention is also directed to now pending patent application Ser. No. 42,509 filed May 25, 1979 (Cylinder Block Having a Cast-In Core Unit and Process for Manufacturing Same now U.S. Pat. No. 4,252,175). This patent application is assigned to the assignee of the present invention.

In some prior art constructions, the cylinder liner of an internal combustion engine and the passages which communicate with the interior bore of the liner are all integrally cast in the engine block. This type of construction is generally disclosed in the above referenced pending patent application as well as by Bie, Short, Guernsey, Severin, Okonski, Winkler, Mantzel, Foster, Kiekhaefer, and Lanpheer. Also, in Bie, Guernsey, Severin, Foster, and Kiekhaefer, the internal combustion engine includes a network of interconnected passages integrally formed in the block, through which passages liquid coolant is circulated to cool the cylinder liner and block during engine operation.

In some prior art constructions, the cylinder liners are mounted within chambers through which liquid coolant is circulated, and the surrounding block structure includes integrally cast passages which communicate with the interior bore of the liner. This construction is generally disclosed by Stancliff, Winkler, Glassey, and Feather.

SUMMARY OF THE INVENTION

The invention generally provides a cylinder liner for an internal combustion engine. The cylinder liner comprises a cylindrical sleeve including a sidewall defining a bore having oppositely spaced ends, the sidewall having therein a port. The cylinder liner also includes means integral with the sleeve and defining a passage communicating with the bore through the port. This passage includes an end portion extending outwardly of the sleeve sidewall and axially toward one of the bore ends.

In one embodiment of the invention, the passage includes a portion communicating with the port and extending radially outwardly from the sleeve sidewall. In this embodiment, the end portion of the passage extends from the radially extending passage portion and includes a terminal end located in a generally coplanar relationship with the one bore end.

In one embodiment of the invention, the sleeve sidewall includes a middle section located in between the oppositely spaced bore ends. In this embodiment, the sidewall port is located generally in this middle section of the sidewall.

In one embodiment of the invention, the sidewall of the cylinder liner further has therein a pair of axially spaced ports. In this embodiment, the cylinder liner further includes means integral with the sleeve and defining a second passage in addition to the first mentioned passage, which second passage extends outwardly of the sleeve sidewall between the pair of axially spaced ports. In this embodiment, the first mentioned passage serves as an exhaust passage, and the second passage serves as a transfer passage.

The invention also provides an engine assembly for an internal combustion engine comprising a cylinder liner generally of the above described construction as well as a block portion which includes means defining an interior chamber having a liner-receiving portion accommodating placement of the cylinder liner substantially wholly within the confines of the liner-receiving portion and adapted to be connected with a source of liquid coolant. The engine assembly further includes assemblage means on the cylinder liner and on the block portion for mounting the liner substantially wholly within the confines of the liner-receiving portion of the interior chamber and for sealing the interior liner bore from communication with the liner-receiving portion of the interior chamber. By virtue of this construction, liquid coolant can be circulated within the liner-receiving portion of the interior chamber to directly cool the liner.

In one embodiment of the invention, the liner sleeve includes an end portion adjacent to the bore end oppositely spaced from the one bore end, and the assemblage means includes wall means defining a generally planar, radially extending ledge and a cylindrical bore extending axially from the ledge and forming part of the interior chamber. The bore of the interior chamber has an internal diameter providing therein an interference fit with the sleeve end portion. In this embodiment, the assemblage means also includes sealing means on either the sleeve end portion or the bore of the interior chamber for engagement between the sleeve end portion and the bore when the sleeve end portion is located in the bore of the interior chamber.

In one embodiment of the invention, the interference fit of the bore of the interior chamber with the sleeve end portion affords removability of the liner from the interior chamber of the body portion.

The invention also provides an internal combustion engine comprising a cylinder liner as above generally described, a block portion also as above generally described, and a head portion which is mounted on the block portion. The head portion includes means for defining a passage having one end communicating with the atmosphere and an opposite end communicating with the outlet end portion of the liner exhaust passage when the liner is mounted on the interior chamber. By virtue of this construction, the engine exhaust can be routed to the atmosphere through the head portion.

In one embodiment of the invention, the head portion includes means defining a passage extending axially along the head portion exhaust passage and communicating with the interior liquid coolant chamber of the block portion. By virtue of this construction, the liquid coolant can be pre-heated in the head portion of the engine.

The invention also provides a method of manufacturing an internal combustion engine having a removable preformed cylinder liner defining an interior bore and further having an exhaust passage communicating with the bore. The method comprises the steps of fabricating a cylinder block having therein an interior chamber having a liner-receiving portion, fabricating the preformed cylinder liner separately from the block, and removably mounting the preformed cylinder liner substantially wholly within the confines of the liner-receiving portion of the interior chamber of the cylinder block and sealing the bore of the cylinder liner from communication with the liner-receiving portion of the interior chamber.

In accordance with one embodiment, the method further includes the steps of fabricating separately from the block and the cylinder liner a cylinder head having therein an exhaust passage communicating with the atmosphere, and mounting the cylinder head on the cylinder block with the cylinder head exhaust passage communicating with the exhaust passage of the cylinder liner.

One of the principal features of the invention is the provision of a preformed cylinder liner for an internal combustion engine, which liner has, as an integral part thereof, an exhaust passage which extends outwardly from the liner and axially toward one end of the liner.

Another one of the principal features of the invention is the provision of a cylinder block associated with the above-described cylinder liner and which has an interior liquid coolant chamber accommodating the mounting of the liner and associated exhaust passage substantially wholly within the confines of the liquid coolant chamber. By virtue of this construction, the cylinder liner can be directly cooled to mimimize distortion and warping due to thermal stresses and may be readily insertable into and removable from the cylinder block to facilitate the manufacturing process and subsequent repair operations.

Yet another one of the principal features of the invention is the provision of an internal combustion engine comprising a cylinder liner having, as an integral part thereof, an exhaust passage, a block portion separately fabricated from the liner and having an interior liquid coolant chamber accommodating therein the removable mounting of the liner, and a head portion separately fabricated from the liner and block and having an exhaust passage communicating with the liner exhaust passage and with the atmosphere. This construction simplifies the casting and machinery operations associated with engine construction, while providing an engine in which warping and fracture due to thermal stresses is minimized.

Other features and advantages of the embodiments of the invention will become apparent upon reviewing the following general description, the drawings and the appended claims.

Figure 1:
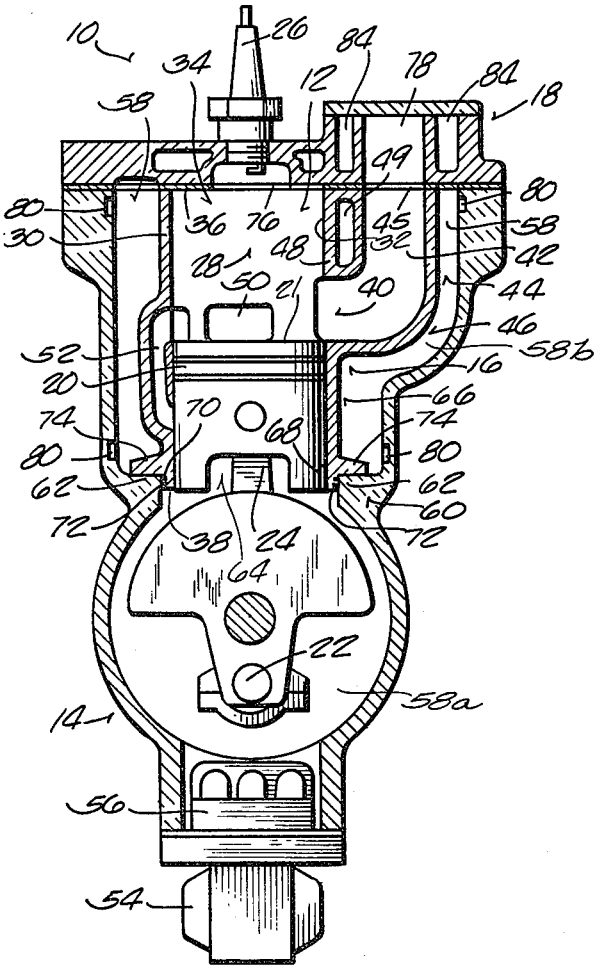
FIG. 1 is a sectional view of an internal combustion engine which embodies various of the features of the invention.

Before explaining the embodiments of the invention in detail, it is to be understood that the invention is not limited in its application to the details of construction and the arrangements of the components as set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which, in the illustrated embodiment, takes the form of a two-stroke engine. While the engine 10 may have one or more cylinders 12, for the purposes of illustration, a single cylinder two-stroke engine is shown.

Figure 2:
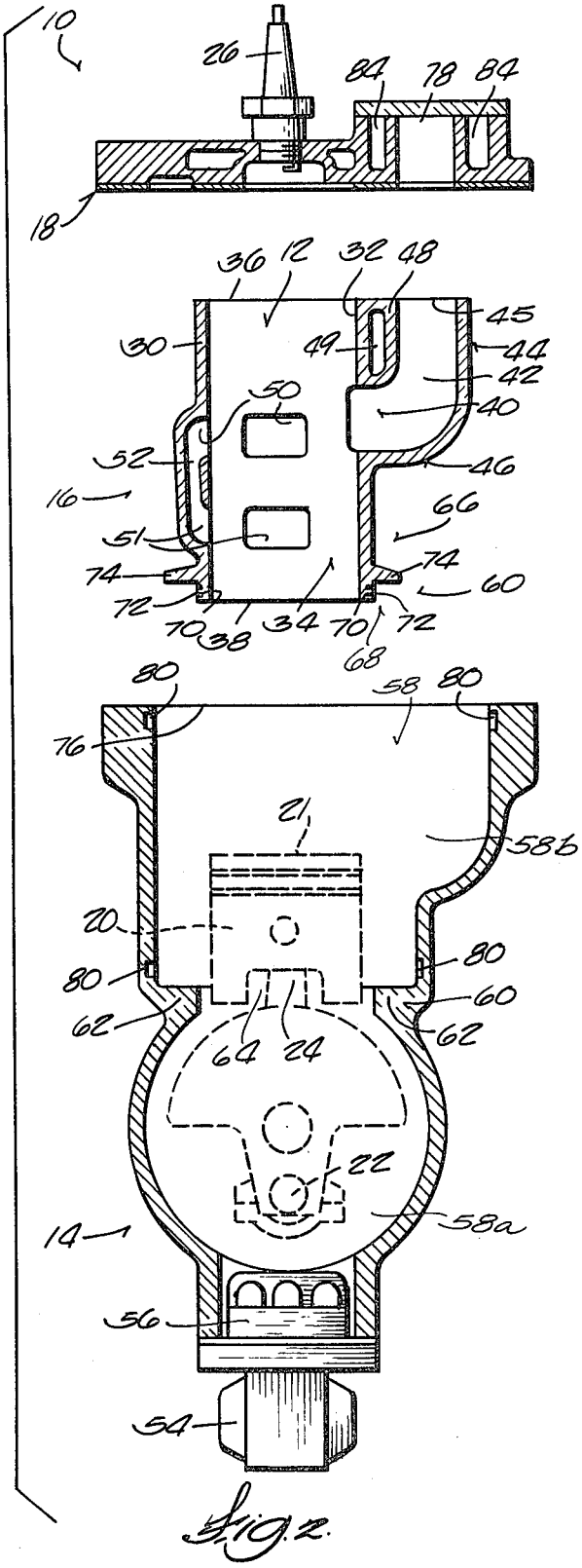
FIG. 2 is an exploded view of the internal combustion engine of FIG. 1 and showing the head portion, the cylinder liner and block portion comprising the engine of FIG. 1.

Generally, and referring now principally to FIG. 2, the engine 10 includes a block portion 14, a cylinder liner 16 located within the block portion 14, and a head portion 18 mounted atop the block portion 14. A piston 20 is supported in the block portion 14 by suitable means, such as a crankshaft 22 and a connecting rod 24, and moves in a reciprocating path within the cylinder liner 16. A conventional spark plug 26 or the like is carried by the head portion 18 and extends into a combustion chamber 28 (see FIG. 1) defined by the variable volume between the head portion 18 and the face 21 of the piston 20. Ignition of a fuel-air mixture introduced into the combustion chamber 28 causes piston reciprocation to drive the engine 10.

Figure 4:
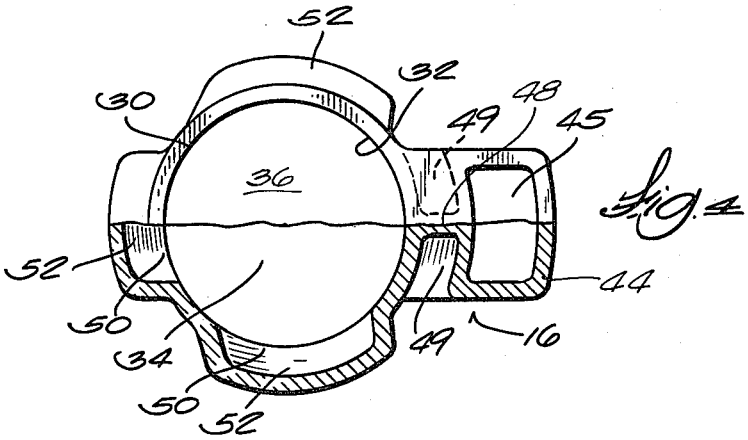
FIG. 4 is a top and partially broken away view of the cylinder liner shown in FIG. 3.
Figure 3:
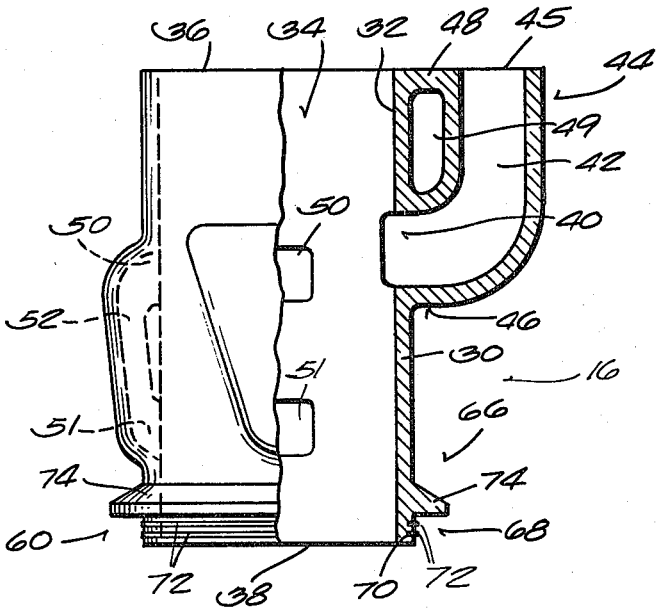
FIG. 3 is a side and partially broken away view of the cylinder liner incorporated in the internal combustion engine shown in FIG. 1.

Referring first to the particular construction of the cylinder liner 16, as is best shown in FIGS. 2 through 4, the liner 16 comprises a cylindrical sleeve 30 which includes a sidewall 32 defining a bore 34 having oppositely spaced ends which will hereafter be referred to, respectively, as the upper bore end 36 and the lower bore end 38. The sidewall 32 has therein a port 40 which, in the illustrated embodiment, is located generally midway between the upper and lower bore ends 36 and 38.

Means integral with the sleeve 30 defines a passage 42 communicating with the bore 34 through the port 40. The passage 42 includes an end portion 44 extending outwardly of the sleeve sidewall 32 and axially toward one of the bore ends. In the illustrated embodiment, the end portion 44 extends axially toward the upper bore end 36.

While the passage 42 may be variously shaped, in the illustrated embodiment, the passage 42 includes a portion 46 which communicates with the port 40 and which extends radially outwardly from the sleeve sidewall 32. The axially extending end portion 44 of the passage 42 extends generally at a right angle from this radially extending passage portion 46. In the illustrated embodiment, the end portion 44 of the passage 42 is fabricated so as to have a terminal end 45 located in a generally coplanar relationship with the upper bore end 36.

Also in the illustrated embodiment, the cylinder liner 16 includes a web 48 which extends between the end portion 44 of the passage 42 and the sleeve sidewall 32 adjacent to the upper bore end 36. The web 48 lends structural strength to the overall assembly.

As described, the passage 40 serves as an exhaust passage through which the end products of fuel ignition in the combustion chamber 28 are discharged from the interior bore 34 during piston reciprocation.

In the illustrated embodiment, the sleeve sidewall 32 further has therein at least one pair of axially spaced ports 50 and 51, and means integral with the sleeve defines another passage 52 extending outwardly of the sleeve sidewall 32 between each pair of axially spaced ports 50 and 51. In the illustrated embodiment, three of such passages 52 are provided (see FIG. 4). Each of these passages 52 serves as a transfer passage, through which the air-fuel mixture is drawn into the combustion chamber 28 from a carburetor 54 (see FIGS. 1 and 2) and an associated reed valve assembly 56 in response to piston reciprocation.

Reference is now made principally to FIGS. 1 and 2 and to the construction of the block portion 14 of the engine 10. The block portion 14 includes means defining an interior chamber 58 having a lower crankcase portion 58*a* and an upper cylinder or liner-receiving portion 58*b*. The upper cylinder portion 58*b* accommodates the placement of the just described cylinder liner 16 substantially wholly within its confines. In addition, assemblage means 60 are provided on the cylinder liner 16 and the block portion 14 for mounting the cylinder liner 16 within the confines of the cylinder portion 58*b* of the interior chamber 58 as well as for sealing the interior liner bore 34 from communication with the cylinder portion 58*b* of the interior block chamber 58.

While the assemblage means 60 may vary, in the illustrated embodiment, the assemblage means 60 includes wall means defining a generally planar, radially extending ledge 62 in the interior chamber 58. A cylindrical bore 64 extends axially from the ledge 62 and forms a part of the interior chamber 58. It is the ledge 62 which effectively divides the interior chamber 58 into its lower crankcase portion 58*a* and its upper cylinder portion 58*b*, and it is through the bore 64 that the piston 20 and connecting rod 24 extend.

In this construction, the liner sleeve 30 includes an end portion 66 (see also FIG. 3) adjacent to the lower end 38, and the interior chamber bore 64 has an internal diameter which provides therein an interference fit with this lower sleeve end portion 66 (as shown in FIG. 1).

The assemblage means 60 further includes sealing means 68 either on the sleeve end portion 66 or in the interior chamber bore 64 for engagement between the sleeve end portion 66 and the bore 64 when the sleeve end portion 66 is located in the bore 64. In the illustrated embodiment (see FIGS. 1, 2 and 3), the liner sleeve 30 includes one or more peripheral grooves 70 formed circumferentially on the sleeve sidewall 32 along the lower sleeve end portion 66, and elastomeric sealing means 72, such as O-rings or the like, are fitted within these grooves 70. These O-rings 72 are compressed between the sidewall 32 of the sleeve end portion 66 and the bore 64 when the two are in interference fit (see FIG. 1), effectively sealing the interior liner bore 34 from communication with the cylinder portion 58*b* of the interior block chamber 58.

In addition, the cylinder liner 16 of the illustrated embodiment further includes a flange 74 which extends radially outwardly of the sleeve end portion 66. This flange 74 fits snugly against the planar ledge 62 (see FIG. 1) when the sleeve end portion 66 is located in the interior chamber bore, thereby serving to assure the proper upright positioning of the cylinder liner 16 within the interior chamber 58 and supporting the cylinder liner 16 against "rocking" movement within the interior block chamber 58. The flange 74 also complements the O-rings 72 in sealing off the interior liner bore 34 from the upper cylinder portion 58*b* of the interior block chamber 58.

As above described, the entire cylinder liner assemblage 16 may be readily inserted into and removed from the cylinder portion 58*b* of the interior block chamber 58. This construction simplifies the overall manufacturing process of the engine 10, as well as facilitates subsequent replacement of a cylinder liner 16 should the liner become damaged or worn in service.

In the illustrated embodiment (as best shown in FIG. 2), the block portion 14 includes an edge 76 defining the top periphery of the interior block chamber 58. When the cylinder liner is properly mounted within the cylinder portion 58*b* of the interior block chamber 58 (see FIG. 1), the terminal end 45 of the exhaust passage 42, the upper bore end 36 of the liner sleeve 30, and the peripheral edge 76 of the interior block chamber 58 are all located in a generally coplanar relationship with each other. Such a coplanar relationship assures proper fitting engagement between the head portion 18 and the block portion 14.

Reference is now made to FIGS. 1 and 2 and the particular construction of the head portion 18 of the engine 10. The head portion 18 includes means for defining a passage 78 communicating with the atmosphere through suitable means (not shown) and also communicating with the terminal end 45 of the liner exhaust passage 42 when the liner 16 is properly mounted in the interior block chamber 58. By virtue of this construction, engine exhaust is routed from the interior liner bore 34 into the head exhaust passage 78 for discharge into the atmosphere.

The cylinder portion 58*b* of the interior block chamber 58 not occupied by the liner 16 is adapted to be connected with a source of liquid coolant (not shown). While various constructions are possible, in the illustrated embodiment, passages 80 which communicate with the source of liquid coolant and with the interior block chamber 58 are integrally formed in the block portion 14. These passages 80 thus conduct the coolant into the interior block chamber 58, and a liquid coolant pump (also not shown) may be provided to continuously circulate the liquid coolant through the interior block chamber 58.

By virtue of this construction, the cylinder liner 16 can be virtually entirely surrounded or enveloped by coolant, and, for this reason, can be referred to as a "wet-type" cylinder liner. Inasmuch as virtually no direct interface exists between the cylinder liner 16 and the block portion 14, except at the juncture formed by the interference fit between the sleeve end portion 66 and the bore 64, the cylinder liner 16 is thermally isolated from the block portion 14. This direct cooling of the cylinder liner 16 reduces distortion and warping of the cylinder liner 16 and associated block portion 14 and head portion 18 resulting from thermal stress. The conduction of heat away from the working parts of the engine 10 is also enhanced by this construction.

The web 48 may also include recesses or passages 49 through which liquid coolant circulates to further enhance engine cooling.

It should be appreciated that suitable plating or coating may be applied to the outer peripheral sidewall surfaces of the cylinder liner 16 in the above described construction to prevent corrosion thereof due to constant contact with the liquid coolant.

In the illustrated embodiment, the head portion 18 includes means defining one or more passages 84 extending axially along the head portion exhaust passage. While the particular structure is not shown in the drawings, the passages 84 communicate by conventional means in common with the liquid coolant passages 80 in the block portion 14 with the source of liquid coolant. Liquid coolant can be thereby conducted along the head portion exhaust passage 78 and is pre-heated by the engine exhaust.

Reference is now made to FIGS. 1 and 2 and to the process of manufacturing the engine 10 just described. While various fabrication methods are possible, in the illustrated embodiment, the block portion 14 is fabricated, such as by casting in a permanent mold or in a high pressure die-casting machine, with a single piece core forming the crankcase and cylinder portions 58*a* and *b* of the interior chamber 58.

The cylinder liner 16 is core molded and cast separately from the block portion 14 thereby forming the unitary, preformed cylinder liner 16 with integrally cast exhaust and transfer passages 42 and 52. This preformed cylinder liner 16 is then mounted substantially wholly within the confines of the cylinder portion 58*b* of the interior block chamber 58, with the bore 34 of the cylinder liner 16 being sealed from communication with the cylinder portin 58*b* interior block chamber 58. This method of construction eliminates the need for additional core units in the block portion 14 to form exhaust and transfer passages since these passages are an integral part of the preformed cylinder liner 16. The terminal end 45 of the exhaust passage 44 and upper bore end 36 of the cylinder liner 16 may be machined into a coplanar relationship with the top peripheral edge 76 of the block chamber 58 simultaneously in a single pass operation.

The head portion 18 is also fabricated in a permanent mold or high pressure die-casting machine separately from the block portion 14 and the cylinder liner 16. Cores therein form the exhaust passage 78 which communicates with the atmosphere as well as the liquid coolant passage or passages 84 which extend axially along the exhaust passage 78. After machining, the head portion 18 is mounted on the block portion 14 with the head portion exhaust passage 78 communicating with the exhaust passage 42 of the cylinder liner 16.

Various of the features of the invention are set forth in the following claims.

I claim:

1. A cylinder liner for an internal combustion engine comprising a cylindrical sleeve including a sidewall defining a bore having oppositely spaced ends, said sidewall having therein a port, means integral with said sleeve and defining a passage communicating with said bore through said port, said passage including an end portion extending outwardly of said sleeve sidewall and axially toward one of said bore ends, and a web extending between said end portion of said passage and said sleeve sidewall adjacent to said one bore end.

2. An internal combustion engine comprising a liner including a cylindrical sleeve including a sidewall defining a bore having oppositely spaced ends, said sidewall having therein an exhaust port, and means defining an exhaust passage extending from said sleeve and communicating with said bore through said exhaust port, said exhaust passage including an outlet end portion extending outwardly said sidewall and axially toward one of said bore ends, a block portion including means defining an interior chamber having a liner-receiving portion accommodating the placement of said liner substantially wholly within the confines of said liner-receiving portion of said interior chamber and adapted to be connected with a source of liquid coolant, assemblage means on said liner and on said block portion for mounting said liner substantially wholly within the confines of said liner-receiving portion of said interior chamber and for sealing said interior bore from communication with said liner-receiving portion of said interior chamber, and a head portion mounted on said block portion, said head portion including means for defining a passage having one end communicating with the atmosphere and an opposite end communicating with said outlet end portion of said liner exhaust passage when said liner is mounted in said interior chamber.

3. An internal combustion engine according to claim 2 wherein said sleeve sidewall includes therein a pair of axially spaced transfer ports and means for defining a transfer passage extending outwardly of said sleeve sidewalls between said axially spaced transfer ports.

4. An internal combustion engine according to claim 2 or 3 wherein said head portion includes means defining a passage extending axially along said head portion exhaust passage and communicating with said interior chamber in said block portion.

5. An internal combustion engine according to claim 4 wherein said assemblage means includes means for removably mounting said liner substantially wholly within the confines of said liner-receiving portion of said interior chamber.

6. A cylinder liner for an internal combustion engine comprising a cylindrical sleeve incuding a sidewall defining a bore having oppositely spaced ends, said sidewall having therein a port, a means integral with said sleeve and defining a passage including a first portion communicating with said port and extending radially outwardly from said sleeve sidewall, and an end portion extending from said radially extending first passage portion in outward relation from said sleeve sidewall and axially toward one of said bore end, said end portion including a terminal end located in generally coplanar relationship with said one bore end.

7. A cylinder liner according to claim 6 wherein said sidewall further has therein a pair of axially spaced ports, and further including means integral with said sleeve and defining a second passage in addition to said first mentioned passage, said second passage extending outwardly of said sleeve sidewall between said pair of axially spaced ports.

8. A cylinder liner according to claim 6 wherein said sleeve sidewall includes a middle section located between said oppositely spaced bore ends, and wherein said sidewall port is located generally in said sidewall middle section.

9. A cylinder liner according to claim 6 and further including a flange extending circumferentially around and radially outwardly of said sleeve sidewall adjacent to said bore end oppositely spaced from said one bore end.

10. A cylinder liner according to claim 9 and further including one or more peripheral grooves formed circumferentially on said sleeve sidewall intermediate said flange and said adjacent bore end, and elastomeric sealing means in each of said grooves.

11. An engine assembly for an internal combustion engine comprising a liner including a cylindrical sleeve including a sidewall defining a bore having oppositely spaced ends, said sidewall having therein a port, and means defining a passage including a first portion communicating with said port and extending radially outwardly from said sleeve sidewall, and an end portion extending from said first passage portion in outward relation to said sidewall and axially toward one of said bore ends and including a terminal end located in coplanar relationship with said one bore end, a block portion including means defining an interior chamber having a liner-receiving portion accommodating placement of said liner substantially wholly within the confines of said liner-receiving portion of said interior chamber and adapted to be connected with a source of liquid coolant, and assemblage means on said liner and on said cast body portion for mounting said liner substantially wholly within the confines of said liner-receiving portion of said interior chamber and for sealing said interior liner bore from communication with said liner-receiving portion of said interior chamber.

12. An engine assembly according to claim 11 wherein said body portion includes an edge defining the top periphery of said interior chamber, and wherein said terminal end of said liner passage end portion, said one bore end of said liner sleeve, and said peripheral edge of said interior chamber are located in a generally coplanar relationship with each other.

13. An engine assembly according to claim 11 wherein said sleeve sidewall includes a middle section located between said oppositely spaced bore ends, and wherein said sidewall port is located generally in said sidewall middle section.

14. An engine assembly according to claim 11 wherein said sidewall further includes therein a pair of axially spaced ports, and wherein said liner includes means defining a second passage in addition to said first mentioned passage, said second passage extending outwardly of said sleeve sidewall between said pair of axially spaced ports.

15. An engine assembly according to claim 11 wherein said sleeve includes an end portion adjacent to said bore end oppositely spaced from said one bore end, and wherein said assemblage means includes wall means defining a generally planar radially extending ledge and a cylindrical bore extending axially from said ledge and forming a part of said interior chamber, said bore having an internal diameter providing therein an interference fit with said sleeve end portion, and sealing means on one of said sleeve end portion and said bore of said interior chamber for engagement between said sleeve end portion and said bore when said sleeve end portion is located in said bore of said interior chamber.

16. An engine assembly according to claim 15 and further including flange means extending radially outwardly of said sleeve end portion for abutment against said planar ledge when said sleeve end portion is located in said bore of said interior chamber.

17. An engine assembly according to claim 15 and wherein the interference fit of said bore of said interior chamber with said sleeve end portion affords removability of said liner from said interior chamber of said body portion.

* * * * *